US007288506B2

(12) United States Patent
Jovancicevic et al.

(10) Patent No.: US 7,288,506 B2
(45) Date of Patent: Oct. 30, 2007

(54) ALUMINUM CARBOXYLATE DRAG REDUCERS FOR HYDROCARBON EMULSIONS

(75) Inventors: Vladimir Jovancicevic, Richmond, TX (US); Samuel Campbell, Richmond, TX (US); Sunder Ramachandran, Sugar Land, TX (US); Paul Hammonds, Katy, TX (US); Steven J. Weghorn, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 618 days.

(21) Appl. No.: 10/720,655

(22) Filed: Nov. 24, 2003

(65) Prior Publication Data

US 2004/0142825 A1 Jul. 22, 2004

Related U.S. Application Data

(60) Provisional application No. 60/477,148, filed on Jun. 9, 2003, provisional application No. 60/436,507, filed on Dec. 26, 2002, provisional application No. 60/429,711, filed on Nov. 27, 2002.

(51) Int. Cl.

| | |
|---|---|
| ***C10M 159/18*** | (2006.01) |
| ***C10L 1/18*** | (2006.01) |
| ***F17D 1/00*** | (2006.01) |

(52) U.S. Cl. ..... 508/506; 508/537; 508/539; 508/579; 507/267; 44/358; 44/362

(58) Field of Classification Search ..... 508/506, 508/537, 539

See application file for complete search history.

(56) References Cited

U.S. PATENT DOCUMENTS 2,492,173 A 12/1949 Mysels (Continued)

FOREIGN PATENT DOCUMENTS

EP 0 029 589 6/1981

(Continued)

OTHER PUBLICATIONS

PCT International Search Report in International Application No. PCT/US03/37692, mailed Jul. 19, 2004, front page and two pages listing cited art.

(Continued)

*Primary Examiner*—Ellen M. McAvoy
(74) *Attorney, Agent, or Firm*—Madan Mossman & Sriram PC

(57) ABSTRACT

Aluminum carboxylate drag reducing agents are described herein. These materials are useful to reduce drag in hydrocarbon fluids and multiphase fluids of hydrocarbon(s) and water. No injection probes or other special equipment is expected to be required to introduce the drag reducing agent into the liquid stream. The drag reducing additives of the invention are not subject to shear degradation and do not cause undesirable changes in the emulsion or fluid quality of the fluid being treated, or undesirable foaming. In one non-limiting embodiment, an aluminum monocarboxylate is reacted with at least one carboxylic acid in situ. In another non-limiting embodiment, the aluminum carboxylate is introduced as a dispersion in a solvent such as paraffin oil. The drag reducing additives include aluminum dicarboxylates such as aluminum dioctoate, aluminum distearate, aluminum octoateoleate, aluminum octoatestearate, aluminum stearateoleate, hydroxyaluminum bis(2-ethylhexanoate) and mixtures thereof.

29 Claims, 2 Drawing Sheets

Drag Reduction v. Concentration of ADO in Cyclopentane

U.S. PATENT DOCUMENTS

| | | | | |
|---|---|---|---|---|
| 2,702,792 | A | 2/1955 | Ashley | |
| 4,104,173 | A | 8/1978 | Gay et al. | |
| 5,800,731 | A * | 9/1998 | Pirck et al. | 252/76 |
| 6,248,699 | B1 | 6/2001 | Subramanian et al. | |
| 6,774,094 | B2 * | 8/2004 | Jovancicevic et al. | 508/506 |
| 6,849,581 | B1 * | 2/2005 | Thompson et al. | 507/118 |
| 2002/0183214 | A1 | 12/2002 | Jovancicevic et al. | |

FOREIGN PATENT DOCUMENTS

| | | | |
|---|---|---|---|
| EP | 0 207 787 | | 7/1985 |
| EP | 0471465 | A2 | 2/1992 |
| FR | 2081693 | | 12/1971 |
| WO | WO 01/66675 | A2 | 9/2001 |
| WO | WO 02/086381 | A1 | 10/2002 |

OTHER PUBLICATIONS

WPI/Derwent Abstract 1986-325112 of SU1227902, 1986.

Partial PCT International Search Report for International Application No. PCT/US03/37692, May 14, 2004.

G. A. Agoston, et al., "Flow of Gasoline Thickened by Napalm," Industrial and Engineering Chemistry, May 1954, pp. 1017-1019, 46:5.

E. W. Merrill, et al., "Study of Turbulent Flows of Dilute Polymer Solutions in a Couette Viscometer," Transactions of the Society of Rheology, 1966, pp. 335-351, 10:1.

F. Rodriguez, "Drag Reduction by a Polymeric Aluminum Soap," Nature Physical Science, Apr. 12, 1971, pp. 152-153, vol. 230.

H. C. Hershey, et al., "Drag Reduction of Straight and Branched Aluminum Disoaps," Ind. Eng. Chem., Prod. Res. Dev., 1975, pp. 192-199, 14:3.

K. C. Lee, et al., "Drag Reduction in Hydrocarbon-Aluminum Soap Polymer Systems," AIChE Symposium Series, 1973, pp. 45-51, 69:130.

I. Radin, et al., "Exploratory Drag Reduction Studies in Non-Polar Soap Systems," Viscous Drag Reduction, C. S. Wells, ed., 1973, pp. 213-231, Plenum Press, New York.

* cited by examiner

Drag Reduction v. Concentration of ADO in Cyclopentane

Viscosity v. Time Curve for ADO at 40°F (4°C)

ALUMINUM CARBOXYLATE DRAG REDUCERS FOR HYDROCARBON EMULSIONS

CROSS-REFERENCES TO RELATED APPLICATIONS

This application claims the benefit of U.S. provisional application No. 60/429,711 filed Nov. 27, 2002; U.S. provisional application No. 60/436,507 flied Dec. 26, 2002; and U.S provisional application No. 60/477,148 filed Jun. 9, 2003.

FIELD OF THE INVENTION

The invention relates to agents to be added to fluids flowing through a conduit to reduce the drag therethrough, and most particularly relates, in one non-limiting embodiment, to non-polymeric, aluminum carboxylate drag reducing agents (DRAs) for liquids such as hydrocarbons, and emulsions of water and hydrocarbons.

BACKGROUND OF THE INVENTION

The use of polyalpha-olefins or copolymers thereof to reduce the drag of a hydrocarbon flowing through a conduit, and hence the energy requirements for such fluid hydrocarbon transportation, is well known. These drag reducing agents or DRAs have taken various forms in the past, including slurries of ground polymer particulates. A problem generally experienced with simply grinding the polyalpha-olefins (PAOs) is that the particles will "cold flow" or stick together after a relatively short time, thus making it impossible to place the PAO in the hydrocarbon in a form that will dissolve or otherwise mix with the hydrocarbon in an efficient manner. Further, the grinding process irreversibly degrades the polymer, thereby reducing the drag reduction efficiency of the polymer.

One common solution to preventing cold flow is to coat the ground polymer particles with an anti-agglomerating agent. Cryogenic grinding of the polymers to produce the particles prior to or simultaneously with coating with an anti-agglomerating agent has also been used. However, some powdered or particulate DRA slurries require special equipment for preparation, storage and injection into a conduit to ensure that the DRA is completely dissolved in the hydrocarbon stream.

Gel or solution DRAs have also been tried in the past. However, these drag reducing gels also demand specialized injection equipment, as well as pressurized delivery systems. They are also limited to about 10% polymer as a maximum concentration in a carrier fluid due to the high solution viscosity of these DRAs. Thus, transportation costs of the DRA are considerable, since up to about 90% of the volume being transported and handled is inert material.

Further, as noted, polymeric DRAs additionally suffer from the problem that the high molecular weight polymer molecules can be irreversibly degraded (reduced in size and thus effectiveness) when subjected to conditions of high shear, such as when they pass through a pump. Additionally, some polymeric DRAs can cause undesirable changes in emulsion or fluid quality, or cause foaming problems when used to reduce the drag of multiphase liquids.

Surfactants, such as quaternary ammonium salt cationic surfactants, are known drag reducing agents in aqueous (non-hydrocarbon) systems and have the advantage over polymeric DRAs in that they do not degrade irreversibly when sheared. In contrast, flow-induced structures in surfactant solutions are reversible.

Thus, it would be desirable if a drag reducing agent could be developed which rapidly dissolves in the flowing hydrocarbon or emulsion, which could minimize or eliminate the need for special equipment for preparation and incorporation into the hydrocarbon or emulsion, and which could avoid or minimize shear degradation. It would be desirable to develop a drag reducing agent that does not cold flow and thus require the use of cryogenic grinding and/or the further addition of an anti-agglomeration additive.

SUMMARY OF THE INVENTION

An object of the invention is to provide a DRA that does not require the use of a polymeric material.

Other objects of the invention include providing a DRA that can be readily manufactured and which does not require special equipment for placement in a conduit transporting hydrocarbons or other fluids.

Another object of the invention is to provide a DRA that does not cold flow upon standing and is stable.

In carrying out these and other objects of the invention, there is provided, in one form, a method of reducing drag of a fluid that involves providing a fluid that is a hydrocarbon or mixture of hydrocarbons, a mixture of hydrocarbons and water, or a mixture of hydrocarbons, water and gas. To this fluid is added a drag reducing composition including an amount of an aluminum carboxylate that is effective to reduce the drag of the fluid, where the viscosity of the fluid is not substantially increased.

In one non-limiting embodiment of the invention, the drag reducing composition in the above method is made by reacting at least one aluminum monocarboxylate with at least one carboxylic acid having from 6 to 54 carbon atoms to form an aluminum dicarboxylate drag reducing additive. The reaction may be conducted prior to and/or simultaneously with adding the drag reducing composition to the fluid.

In an alternate, non-limiting embodiment of the invention, the drag reducing composition in the above method is a dispersion comprising from about 5 to about 50 vol % of at least one aluminum dicarboxylate and at least one solvent that is a paraffin oil, a fatty acid ester, a glycol, a diglycol, a polyglycol, a low molecular weight poly(alpha-olefin), or a mixture thereof.

In another non-limiting embodiment of the invention, there is provided a reduced drag fluid that includes a fluid that may be a hydrocarbon or mixture of hydrocarbons, a mixture of hydrocarbons and water, or a mixture of hydrocarbons, water and gas. The fluid also includes a drag reducing composition having an amount of an aluminum carboxylate effective to reduce the drag of the fluid, where the bulk fluid viscosity of the fluid is not increased by the aluminum carboxylate.

The invention also involves in one non-limiting embodiment, a drag reducing dispersion composition per se having from about 5 to about 50 vol % of at least one aluminum dicarboxylate and at least one solvent that is a paraffin oil, a fatty acid ester, a glycol, a diglycol, a polyglycol, a low molecular weight poly(alpha-olefin), or a mixture thereof.

Additionally, the invention concerns a method of making a drag reducing dispersion composition that involves combining in any sequence the components of at least one aluminum monocarboxylate, at least one carboxylic acid having from 6 to 54 carbon atoms, and at least one solvent that is a paraffin oil, a fatty acid ester, a glycol, a diglycol, a polyglycol, a low molecular weight poly(alpha-olefin), or a mixture thereof. The components are mixed to form a suspension of at least one aluminum dicarboxylate in the solvent.

DETAILED DESCRIPTION OF THE INVENTION

Figure 1:
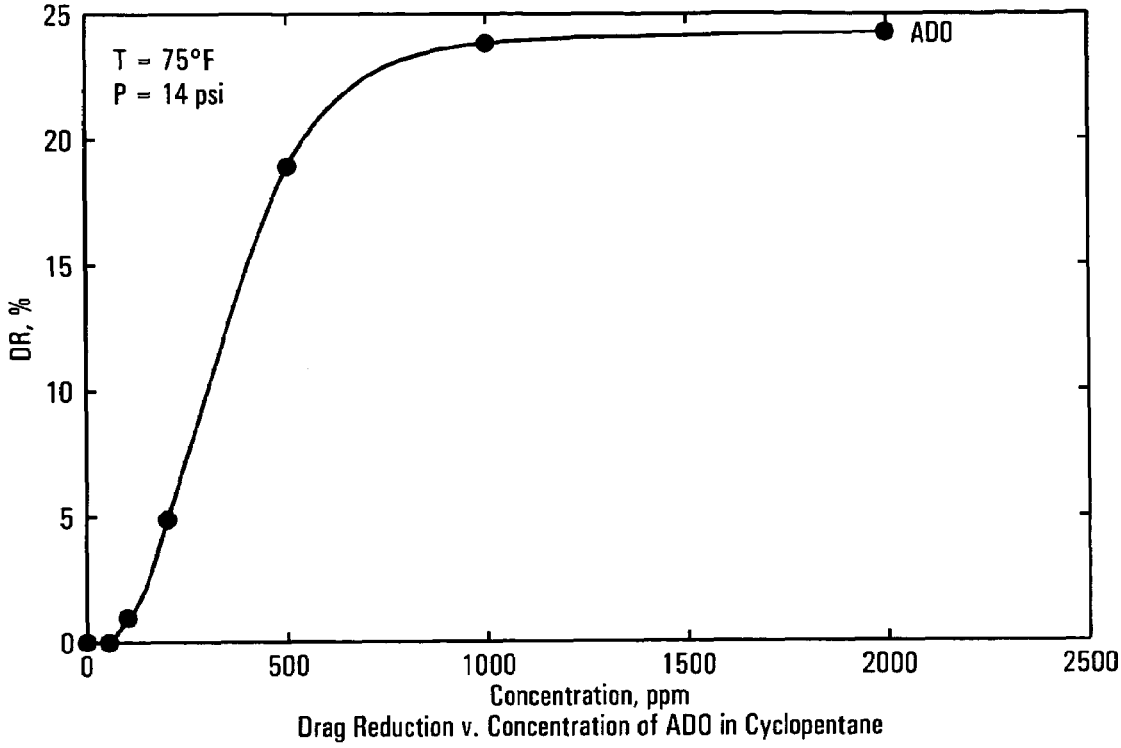
FIG. 1 is a graph of the profile of drag reduction as a function of concentration for aluminum dioctoate (ADO) in cyclopentane obtained in the torque test.

The present invention relates to methods and compositions for reducing drag and improving flow in turbulent hydrocarbon systems with little or no substantial change in the bulk fluid viscosity of the system. Hydrocarbon systems include, but are not necessarily limited to, any flowing stream that has a large hydrocarbon component. By "large hydrocarbon component" is meant at least 10 volume percent hydrocarbon or oleaginous material. Hydrocarbon systems include, but are not necessarily limited to, multiphase flowlines (for example oil/water, water/oil, oil/water/gas) in oil and gas production systems, including gas transmission lines (e.g. gas/condensate, gas/condensate/water). It is expected that the invention could apply to any hydrocarbon fluid flowing in a pipeline or well, whether or not water or gas is present. It will be appreciated that by the term "hydrocarbon fluid", it is expected that oxygenated hydrocarbons such as methanol, ethanol, ethers, and the like are included within the definition. The term "hydrocarbon fluid" also means any fluid that contains hydrocarbons, as defined herein to also include oxygenated hydrocarbons. Thus, multiphase hydrocarbon-containing systems (e.g. oil/water, oil/gas, oil/water/gas), such as oil production flow lines and gas export lines are primary applications for this technology. Conventional polymeric-based drag reducers (e.g. poly(alpha-olefins)) are generally not suitable for these applications either because of their high intrinsic viscosity and/or system fluid incompatibility.

The present invention also relates to highly concentrated, low viscosity compositions and their use in reducing drag and improving flow in turbulent hydrocarbon systems with little or no substantial change in the bulk fluid viscosity of the system. In this invention, concentrated dispersions of aluminum di-acids (selected from saturated or unsaturated fatty acids including, but not necessarily limited to, octoates, stearates, oleates or naphthenates) are prepared. The aluminum carboxylate can be applied via continuous treatments at high enough concentrations to produce the desired reduction in pressure drop and/or increase in flow.

Many oil and gas production systems (e.g. those that transport and produce gas and oil from deep water reservoirs in the Gulf of Mexico and elsewhere) are limited in their production due to pressure drop in the flowlines under turbulent flow regime. The drag reducing methods of the invention comprise applying additives to the system by either batch or continuous treatments at high enough concentrations to produce the desired reduction in drag and/or increase in flow for the same amount of motive energy. The compositions containing the additive are used effectively by maintaining drag reduction effectiveness over an extended period of time. The use of these types of additives present distinct advantages over the use of conventional polymeric drag reducers including the facts that they can be introduced to the pipeline in a form that is less shear sensitive and do not cause undesirable changes in emulsion, foaming or fluid quality. Without wishing to be limited to any particular mechanism of operation, the microstructures or associations between the molecules of the inventive additives are believed to reform after the fluid is sheared. Reduction in pressure drop in gas, condensate and oil single phase or multiphase flowlines by using inventive aluminum carboxylates allows operators to increase production.

It is known to use relatively high concentrations of aluminum soap thickeners (approximately 2.5-5 wt %) to convert gasoline into a thixotropic gel and pump this mixture through a pipe at higher rates than that of the unthickened liquid. These compositions and methods undesirably and substantially increase the bulk viscosity of the fluid or thicken the fluid, under conditions of low or no shear. In contrast, the methods of this invention involve applying relatively low dosages of aluminum carboxylates, particularly aluminum dicarboxylates to a hydrocarbon system or stream with no change in the bulk viscosity or thickness of the hydrocarbon.

In the instant invention, the viscoelastic solutions of aluminum acids, and in particular aluminum diacids, are made using acids selected from saturated or unsaturated fatty acids, e.g. octoate, stearate, oleate, naphthenates, etc., that provide low viscosity and high elasticity characteristics formulated in suitable organic solvent. As will be discussed further below, the solvent may play a role in the performance of aluminum dicarboxylates. The formation of stable molecular structures (e.g. micelles and the like) and the associated viscoelastic properties of those structures in the hydrocarbon systems may be very important for their drag reduction.

The saturated or unsaturated fatty acids used to prepare the aluminum carboxylates of this invention, both the aluminum monocarboxylates and aluminum dicarboxylates, have the basic chemical structures of fatty acids, namely a hydrocarbon moiety having one or more carboxylic acid groups (—COOH) and may be saturated or unsaturated, linear or branched. In one non-limiting embodiment of the invention, dicarboxylic acids are preferred. In another non-limiting embodiment, the number of carbon atoms in the carboxylic acid range from about 6 to about 54, preferably from about 8 to about 36 carbon atoms, and alternatively from about 6 to about 20 carbon atoms. It should be recognized that often a distribution of acids of different carbon numbers may be used to produce the aluminum carboxylates of this invention, and that it is not necessary to use a carboxylic acid that is extremely pure or has only one carbon number. In one non-limiting embodiment of the invention, it is preferred that higher chain length acids are used, that is those having at least about 6 carbon atoms, preferably at least about 8 carbon atoms.

In another non-limiting embodiment of the invention, linear and branched saturated and unsaturated carboxylic acids are included as additives or reactants of the invention. That is, the carboxylic acid reactant may be used in molar excess, and such molar excess is preferable in some embodiments. In another non-limiting embodiment, the carboxylic acid reactant may be used in sub-stoichiometric amounts ranging from about 0.5 to about 1.0 molar equivalents relative to the aluminum carboxylates, and in another non-limiting embodiment from about 0.85 to about 1.0 molar equivalents. Specific examples of such fatty acids suitable as reactants and/or additives include, but are not necessarily limited to, oleic acid, linoleic acid, stearic acid, palmitic acid, octanoic acid, naphthenic acid, 2-ethyl hexanoic acid, dimer/trimer acids and the like. The exact drag reduction properties of aluminum dicarboxylates obtained depend upon a number of complex, interrelated factors, including, but not necessarily limited to, the concentration of aluminum salt, the type of acid (chain length, linear/branched), the type and amount of solvent used, the composition and nature of the treated fluid, the temperature, viscosity, etc. of the treated fluid, and the like. The additives of this invention may also include alkoxylated derivatives of fatty acids. By "alkoxylated fatty acid derivative" is meant any fatty acid that has been reacted with an alkoxide using known or future methods. The alkoxide may include, but is not necessarily limited to ethylene oxide, propylene oxide, butylene oxide and mixtures thereof. In one embodiment of the invention, the extent of alkoxylation should not be so great as to interfere with the objectives of the invention, which include solubility in the fluid. In one non-limiting example, the extent of alkoxylation may range from about 1 to about 100 alkoxy units, preferably from about 5 to about 20 alkoxy units. Again, the alkoxy units may be mixed types, and may be present in blocks or random arrangement. Terminal carboxylic acid functionality should remain or be provided so that the alkoxylated derivates can react with the aluminum compounds. Hydrolysis of the polyglycol ester to a carboxylic acid prior to or during reaction with an aluminum compound may also be considered.

Suitable organic solvents for use with the aluminum carboxylate salts of this invention include aliphatic and aromatic solvents. More particularly, suitable solvents include, but are not necessarily limited to, xylene, kerosene, alcohols, ethers, esters, and mixtures thereof. The proportion of aluminum carboxylate in the solvent may range from about 5 to about 70 wt %, preferably from about 8 to about 50 wt %. In one preferred, non-limiting embodiment of the invention, the aluminum salts of relatively long chain carboxylic acids are generally more effective, and aromatic solvents are better than aliphatic solvents at the same aluminum salt level. Without wishing to limit the invention to any particular mechanism, it may be that particular solvents help stabilize the molecular structures that reduce drag.

In another non-limiting embodiment of the present invention, the compositions containing aluminum carboxylates solubilized in a suitable organic solvent (component A) are activated by or reacted with another oil-soluble carboxylic acid (component B) at the system temperature (in one non-limiting embodiment, >120° F. (>49° C.)), either prior to being injected or in situ, to produce enhanced drag reduction effects. The low viscosity, high solubility and high activity (i.e. high concentration of active species) of the resulting mixture AB allow the drag reducer to be injected in the oil/gas flow lines without potential adverse effects on the injection system or downstream separation and processing. Kinetics of the activation of AB mixture are controlled by the hydrocarbon system, or injection system, temperature (in one non-limiting embodiment, >120° F. (>49° C.)), time and concentration (e.g., <1 hour at 120° F. (49° C.) to complete the reaction at 8% active for maximum drag reduction). This "in situ" activation of aluminum carboxylate allows for a significant increase in product activity and/or compatibility with the injection system. The aluminum carboxylates (component A) are selected from aluminum salts of saturated or unsaturated fatty acids previously described (e.g. octoates, stearates, oleates or naphthenates), and fatty acids (component B) were selected from saturated or unsaturated carboxylic acids ($C_6$-$C_{54}$). The methods comprise applying a combination of aluminum carboxylate and fatty acid (AB) to a hydrocarbon system via continuous injection through an umbilical/capillary at a high enough concentration to produce the desired drag reduction by reacting them at the system temperature, or prior to injection into the system. Drag reduction obtained by an "in situ" formed aluminum diacid is comparable to drag reduction of a fully activated aluminum diacid. Alternatively, the two components (A and B) can be reacted in the injection system (e.g. heated in-line mixer, continuous stirred tank reactor (CSTR), etc.) prior to being introduced into the production system.

In one non-limiting embodiment of the instant invention, the viscoelastic solutions of aluminum diacids are made using acids selected from saturated or unsaturated fatty acids, e.g. octoate, stearate, oleate, naphthenates, etc., that provide low viscosity and high elasticity characteristics formulated in suitable organic solvent. As discussed elsewhere herein, the solvent may play a role in the performance of aluminum dicarboxylates. The formation of stable molecular structures (e.g. micelles and the like) and the associated viscoelastic properties of those structures in the hydrocarbon systems may be very important for their drag reduction.

It has been discovered that the synthesis or production of aluminum dicarboxylates just prior to or simultaneously with injection, placement or introduction into the fluid provides particular advantages, including, but not necessarily limited to, (i) an ability to inject the partially reacted product; (ii) the viscosity of the material is lower and allows conventional pumps to be used; (iii) higher concentrations of product may be achieved permitting lower injection rates; (iv) a larger proportion of the final aluminum dicarboxylate product is not passed through the pumps and is therefore not shear degraded; and (v) the product viscosity is little affected by the range of ambient temperature found at production sites around the globe. The suitable saturated or unsaturated fatty acids have been previously described, as have been the suitable organic solvents.

Without wishing to be limited to any particular theory or explanation, drag reduction properties of aluminum carboxylates appear to depend on the combinations of linear/branched, saturated/unsaturated fatty acids and the type of solvent used, but the invention should not be limited by any particular theory. Thus, in one non-limiting embodiment of the invention, the aluminum salts of a combination of short and long chain carboxylic acids may provide optimum balance between drag reduction and viscosity of the combination. In another non-limiting embodiment of the invention, the higher the aluminum compound content, the more effective the drag reducers and more viscous the product. Stated another way, a preferred performance is obtained with combinations of lower and higher chain length acids (e.g. octoate and oleate) providing an optimum balance between highest level of aluminum and the largest size of molecular structures (high elasticity) in the hydrocarbon.

The aluminum dicarboxylates of this invention are prepared by reacting aluminum alkoxides or carboxylates with the fatty acids in an aromatic solvent at an elevated temperature (in one non-limiting embodiment, greater than or equal to 120° C.) for approximately 1 hour until a stable viscoelastic solution is obtained. In one embodiment of the invention, the reacting of the aluminum alkoxides or carboxylates with the fatty acids may be conducted at a temperature ranging from room temperature (about 25° C.) or below to about 350° F. (about 177° C.). In another non-limiting embodiment of the invention, the reaction is conducted at a temperature from about 120 to about 325° F. (about 49° C. to about 163° C.). While the reaction proceeds relatively slowly at room temperature and below, it does proceed. Further, at temperatures above about 350° F. (about 177° C.), decomposition of the aluminum dicarboxylate(s) may occur. Typical concentrations of viscoelastic aluminum diacid solutions used are within a 1-50% range, in another non-limiting embodiment from about 5 to about 40%, and in a non-limiting alternative embodiment from about 8 to about 30% range, based on the total additive. It will be appreciated that the aluminum dicarboxylate product may include more than one aluminum dicarboxylate.

Alternatively, viscoelastic aluminum diacid solutions can be prepared by heating a dry powdered form of the aluminum dicarboxylate in a suitable hydrocarbon solvent. Suitable solvents in this instance include, but are not necessarily limited to, xylene, kerosene, alcohols, ethers, esters, and mixtures thereof.

Alternatively, it has been discovered that the concentrated, low viscosity, drag reducing dispersion compositions of this invention are readily pourable and pumpable and particularly suitable for incorporation into multiphase flow. The dosage rate may be decreased by using these dispersions, and capital costs can be reduced over some conventional DRAs by not requiring any special pumping equipment.

In one particular embodiment of the invention the aluminum dicarboxylates are made in or made prior to combination with at least one solvent selected from the group consisting of paraffin oils, fatty acid esters, glycols, diglycols, polyglycols, low molecular weight poly(alpha-olefins), and mixtures thereof to make dispersions. In this way the aluminum dicarboxylates are dispersed within the solvent which enhances their delivery into a hydrocarbon-containing fluid. Suitable fatty acid esters include, but are not necessarily limited to, methyl oleate, methyl caprylate, methyl caprate, isopropyl octoate, isopropyl myristate, soybean oil methyl esters, coconut oil methyl esters, and tall oil methyl esters, and mixtures thereof. Suitable glycols include, but are not necessarily limited to, ethylene glycol, propylene glycol, hexylene glycol, and mixtures thereof. Suitable diglycols include, but are not necessarily limited to, diethylene glycol and dipropylene glycol, and mixtures thereof. Suitable polyglycols include, but are not necessarily limited to, tripropylene glycols, polypropylene glycols of from about 200-2000 molecular weight, and mixtures thereof. Suitable poly(alpha-olefins) include, but are not necessarily limited to, those having about 800 molecular weight or less. Of course, these solvents can be used alone or in combination.

In one non-limiting dispersion embodiment of the invention, a paraffin oil is a preferred solvent and the paraffin oil has a viscosity greater than about 20 centistokes at 40° C. In one non-limiting embodiment of the invention, the dispersion has from about 5 to about 50 volume percent of at least one aluminum dicarboxylate in the solvent. In another non-limiting embodiment, the proportion of aluminum dicarboxylate ranges from about 20-50 vol %, and in an alternate embodiment of the invention, the aluminum dicarboxylate ranges from about 35-50 vol % of the solvent.

In preparing the drag reducing dispersion compositions of the invention, it is generally preferred to vigorously agitate or mix the components to completely disperse the aluminum dicarboxylates in the solvent. The goal is to make a stable dispersion, where stable is defined herein to mean that no separation is observed after the dispersion stands without mixing for 14 days. In contrast, vigorous mixing or agitation is deleterious to the ultimate performance of conventional viscoelastic DRA gels.

Suitable optional, organic co-solvents for use with the solvents of this invention include alcohols, aromatic hydrocarbons or light hydrocarbons. Examples of suitable alcohols include, but are not necessarily limited to, linear or branched, propanols, butanols octanols, decanols, tridecanols, and ethoxylated and/or propoxylated alcohols and mixtures thereof. Examples of suitable aromatic hydrocarbons include, but are not necessarily limited to, benzene, toluene, cumene, xylene, and mixtures thereof. Examples of light hydrocarbons that are suitable include, but are not necessarily limited to, pentane, cyclopentane, hexane, cyclohexane, heptane, methylcyclohexane, decane, hexadecane, and olefins such as decene, dodecene, and hexadecene. Light hydrocarbons are defined herein as straight, branched or cyclic hydrocarbons having sixteen (16) or fewer carbon atoms. Without wishing to limit the invention to any particular mechanism, it may be that particular solvents help stabilize the molecular structures that reduce drag.

In one non-limiting embodiment of the invention, the drag reducing dispersion compositions of the invention have a viscosity of from about 20 to 500,000 centipoise (cP), and in another, alternate embodiment have a viscosity of from about 20 to 200 cP at 25° C.

In one non-limiting embodiment of this invention, specific examples of the aluminum carboxylate drag reducing additives include, but are not necessarily limited to, aluminum dioctoate, aluminum distearate, aluminum octoateoleate, aluminum octoatestearate, aluminum stearateoleate, hydroxyaluminum bis-(2-ethylhexanoate), and mixtures thereof.

In one non-limiting embodiment of the invention, the drag reducing additives herein are added in the absence of any polymeric drag reducing additive. In another non-limiting embodiment of the invention, the drag reducing additives are employed in the absence of any other drag reducing additive, i.e. one that does not fall within the definitions of this invention. On the other hand, there may be situations or environments where it is advantageous to employ other drag reducing additives together with those of this invention in effective mixtures, such mixtures being within the bounds of this invention. For instance, such mixtures may be helpful in spreading the drag reduction effects of the additives further over time and/or distance.

The typical use levels in the actual system for drag reduction is substantially less than that for other known aluminum soap drag reducer additives, based on total system fluid, i.e. from about 10 to 2000 ppm for methods of this invention, preferably from about 50 to about 1000 ppm, and most preferably from about 100 ppm to about 500 ppm. In the dispersion embodiment of the invention, the amount of dispersion based on the total system fluid may range from about 1 to about 300 ppm in one non-limiting embodiment, and from about 5 to about 50 ppm in an alternate, non-limiting embodiment. The maximum drag reduction effects observed, including both pressure reduction ($\Delta P$) and flow increase (Q), in the laboratory flowloop testing were between about 30 to about 40%, depending on the acid combination and the solvent used, although the invention should not be limited by this range. In the case of the dispersion embodiment, the maximum drag reduction effects observed were in the range of about 20 to about 30%. It will be appreciated that it is virtually impossible to predict in advance what an effective amount of drag reducing agent would be in any particular circumstance since there are a number of interrelated factors that must be considered including, but not necessarily limited to, the type of fluid having its friction characteristics modified, the flow rate of the fluid, the temperature of the fluid, the nature of the DRA, etc. Thus, the dosage ranges given above and used in the Examples should be understood as illustrative only.

The compositions containing aluminum carboxylates are used effectively by maintaining drag reduction effectiveness in hydrocarbon systems over extended periods of time, on the order of hours. The use of the viscoelastic (shear thinning) aluminum dicarboxylate solutions and non-viscoelastic aluminum dicarboxylate dispersions present a number of advantages over the use of conventional polymeric drag reducers for hydrocarbon systems in that they are more easily handled and delivered, i.e. they have lower viscosity, on the order of about 1,000 to 50,000 cP at 25° C. under conditions of low or no shear. In the embodiment where the low-viscosity aluminum carboxylate solutions (AB) are used, the viscosity of the aluminum dicarboxylate compositions being injected through the umbilical depends on the temperature of the environment, time and concentration of the product. For example, in subsea applications, the viscosity of an 8% product can be maintained below 30 cP for 10 days. In surface applications, pumpable viscosity product (<100,000 cP) can be obtained even at 50% actives.

The viscosity of the aluminum di-acid solutions of this invention can be further reduced by the use of small, optional amounts of amines, amides, and/or imides without adverse effect on drag reduction, in one non-limiting embodiment of the invention. More specifically, but as non-limiting examples, the amounts of the amines, amides, and/or imides range from about 10 to about 5000 ppm based on the total amount of additive (aluminum salt plus any solvent), preferably from about 100 to about 1000 ppm. Suitable amines, amides, and/or imides include, but are not necessarily limited to, $C_8$-$C_{18}$ amines, $C_8$-$C_{18}$ amides, $C_8$-$C_{18}$ amidoimidazolines, imidazolines, and mixtures thereof.

One non-limiting manner of practicing the invention is batch treatment between two pigs. In an alternative, non-limiting embodiment, the invention may include continuous treatment through umbilicals or capillaries. In the embodiment where the two-component low viscosity aluminum carboxylate solutions (AB) are used, continuous treatment is generally desired. In the continuous treatment, the product solution is used at high enough concentration to produce the desired drag reduction without causing emulsion, foaming or other oil/water quality problems. The reduction in pressure drop in a multiphase flow line is achieved by reduction in turbulence in the presence of the aluminum carboxylate in the hydrocarbon system.

Other suitable additives that may also be included with the aluminum carboxylates of the invention include but are not necessarily limited to non-amine based corrosion inhibitors, such as fatty acid-based inhibitors.

The use of aluminum dicarboxylate dispersions presents advantages over the use of conventional polymeric drag reducers and some aluminum dicarboxylate viscoelastic solutions for hydrocarbon systems in that the former are free flowing, low viscosity products. As such, they can be more easily handled and delivered to the production system. The use of aluminum dicarboxylate dispersions provide the further advantage over the use of some aluminum dicarboxylate viscoelastic solutions in that the former are more concentrated in active product, thereby decreasing the dose rate needed to achieve effective drag reduction. Additionally, the aluminum dicarboxylate dispersions are much less susceptible to shear degradation commonly encountered in the transport and delivery of conventional polymeric DRAs, as are these drag reducing compositions in general. Some aluminum dicarboxylate solutions may be difficult to manufacture on a large scale due to the high viscosity of the product, in contrast with the relatively low viscosity dispersions of this invention. The aluminum dicarboxylate dispersions of this invention also contain no flammable or toxic solvents, and are thus less likely to have negative effects on the environment, and they are safer to manufacture, transport, and apply than some conventional drag reducing agents.

To further illustrate the invention, the inventive method will be additionally described by way of the following non-limiting Examples, which are intended only to further show specific embodiments of the invention.

EXAMPLE 1

Various combinations of fatty acids and their ratios in organic solvent, combinations of fatty acids and aluminum carboxylates, and aluminum carboxylate dispersions were evaluated to determine the optimum composition for their overall drag reduction effect and resistance to shearing. Two basic tests were employed to evaluate the drag reduction properties of these solutions, namely the torque (rotational viscometer) test and the single pass flow apparatus test.

Torque testing was carried out in a double walled cylindrical glass cell (100 mL) with temperature controlled by using a water bath. Inside the glass cylinder an aluminum cylinder spun at a constant rate in the fluid of interest (2 mm thick). The cylinder was attached to a torque meter, which sends an analog voltage through a frequency filter where the signal is converted to a digital signal that is logged into a computer. The DRA was added in increments using a micro-syringe and a concentration profile was obtained. All tests were carried out in cyclopentane at 22° C., except in the embodiment where an aluminum monocarboxlate is reacted with at least one carboxylic acid in situ, which were carried out at 85° C.

Percent drag reduction for a particular DRA/cyclopentane system in the torque test is calculated by using the formula:

$$DR\ \% = 100 \times \frac{(Torque_{Sol} - Torque_{DRA})}{(Torque_{Sol} - Torque_{Air})}$$

where $Torque_{Air}$, $Torque_{Sol}$ and $Torque_{DRA}$ are torque values in air, solution without DRA and solution with DRA, respectively. The term $t_{DR=0}$ is defined as the time for the drag reduction effect to reach zero, that is, a measure of the rate of DRA degradation.

The effect of the acid combination and acid chain length (short vs. long) in aluminum carboxylates on drag reduction is shown in Table I. Table I also shows the change in pressure drop ($\delta\Delta P$) and increase in flow ($\Delta Q$) due to the presence of aluminum carboxylates. The role of solvent in aluminum di-acids is shown in Table II.

TABLE I

Effect of Acid Combination and Acid Chain Length in Aluminum Carboxylates on Drag Reduction

| Al Carboxylate[a] | Dosage Rate[b] ppm | DR % | $t_{DR=0}$ hour | δΔP % | ΔQ % |
|---|---|---|---|---|---|
| Blank | 0 | | | | |
| Al di-octoate | 1000 | 25 | >3 | −7 | 5 |
| Al di-stearate | 1000 | 9 | >3 | | |
| Al octoateoleate | 1000 | 22 | >3 | | |
| Al octoatestearate | 1000 | 19 | >3 | | |
| Al stearateoleate | 1000 | 15 | <1 | −5 | 3 |

[a]5% in Xylene
[b]In cyclopentane

TABLE II

Role of Solvent in Aluminum Di-acids

| Al Carboxylate[a]/solvent | Dosage Rate[b] ppm | DR % | $t_{DR-0}$ hour |
|---|---|---|---|
| Blank | 0 | | |
| Al di-octoate/kerosene | 1000 | 24 | >3 |
| Al di-octoate/xylene | 1000 | 25 | >3 |
| Al octoateoleate/xylene | 1000 | 22 | >3 |
| Al octoateoleate/kerosene | 1000 | 23 | <1 |

[a]5%
[b]In cyclopentane

EXAMPLE 2

The drag reduction—concentration profile for aluminum dioctoate (ADO) in cyclopentane obtained in the torque test is shown in FIG. 1. These results indicate high drag reduction activity of ADO in cyclopentane with minimum effective concentration of ~500 ppm. The stability to shear of aluminum diacids formulated in two different solvents (kerosene and xylene) in cyclopentane at 1000 ppm is shown in Table II. The results show little reduction in activity of ODO in both solvents over 3 hours in the torque test.

In Situ Reaction of Aluminum Monocarboxylate with Carboxylic Acid

The effect of two aluminum dicarboxylates, aluminum dioctoate (ADO) and aluminum octoateoleate (AOO), on drag reduction of fully activated (1 hour at 120° C.) and in situ activated product (at 85° C.) in cyclopentane at 1000 ppm is shown in Table III. The results show good drag reduction properties of the temperature activated aluminum carboxylate.

TABLE III

Effect of Acid Combination and Acid Chain Length in Aluminum Carboxylates on Drag Reduction

| Al Carboxylate[a] | Concentration ppm | DR % Fully activated | DR % In situ activated |
|---|---|---|---|
| Blank | 0 | 0 | 0 |
| Al dioctoate | 1000 | 24 | 7 |
| Al dioctoate | 2000 | 25 | 16 |
| Al octoateoleate | 3000 | 22 | 11 |

[a]5% in Xylene
[b]1000 ppm in cyclopentane

EXAMPLE 3

Figure 2:
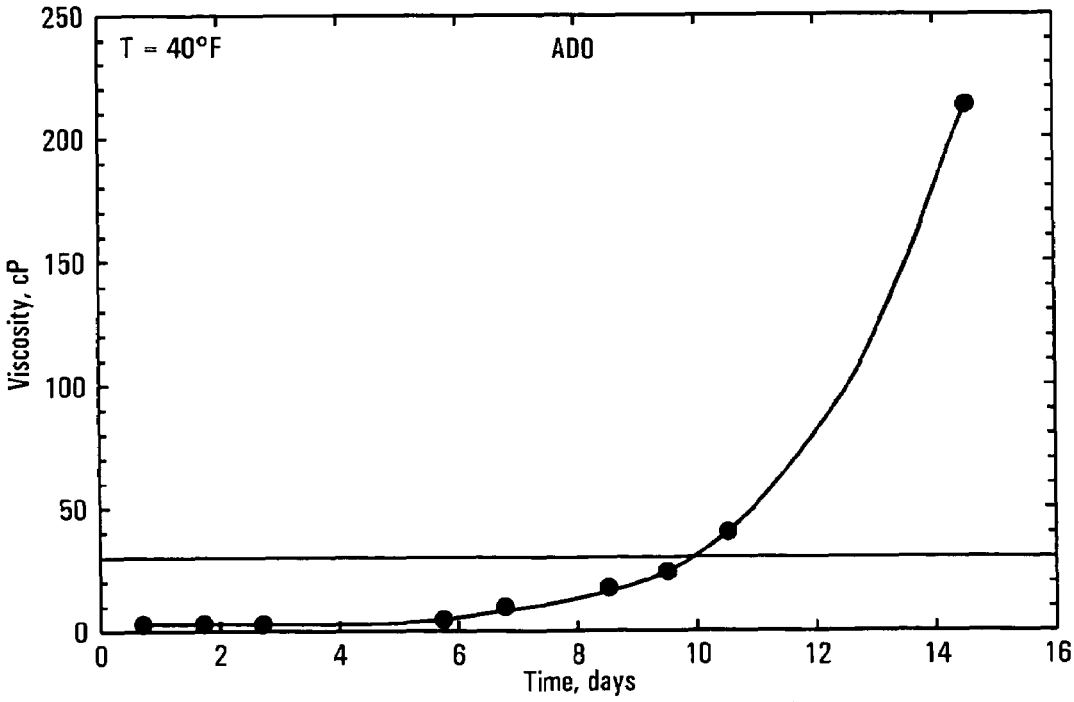
FIG. 2 is a graph of viscosity in cP as a function of time in days at 40° F. (4° C.) for aluminum dioctoate (ADO) for this invention.

The viscosity of the 8% aluminum carboxylates, ADO and AOO, in xylene at 40 and 75° F. (4 and 24° C.) was determined as a function of time. The curve for ADO is shown in FIG. 2. The relatively low viscosity of the AB mixtures of <30 cP obtained at 40° F. (4° C.) over an extended time period (days) demonstrates the suitability of the aluminum carboxylate mixtures for injection via umbilical into the flow lines. Thus, in the event of well shut-in for days at the time, no significant changes in viscosity/injectability are expected.

EXAMPLE 4

Preparation of DRA Dispersion in Light Paraffinic Oil

To 50 parts light paraffin oil (viscosity=18 cP at 25° C.) were added 31.25 parts OAO-EF oxyaluminum octoate (available from Chattem Chemicals, Inc.) and 18.75 parts 2-ethylhexanoic acid. The mixture was mixed vigorously with an overhead stirrer apparatus. The clear solution was heated to 120° C. for one hour. After cooling, the product DRA dispersion of hydroxyaluminum bis-(2-ethylhexanoate), was obtained as an opaque liquid with a viscosity of 85 cP at 25° C.

EXAMPLE 5

Preparation of DRA Dispersion in Heavy Paraffinic Oil

The process of Example 4 was followed using heavy paraffinic oil (viscosity=96 cP at 25° C.) instead of light paraffinic oil. The white opaque liquid that resulted had a viscosity of 260 cP at 25° C.

EXAMPLE 6

Preparation of DRA Dispersion in 90:10 Heavy Paraffinic Oil:Isopar M Oil

The process of Example 4 was followed using 45 parts heavy paraffinic oil (viscosity=96 cP at 25° C.) and 5 parts Isopar M oil instead of light paraffinic oil. The white opaque DRA dispersion that resulted had a viscosity of 250 cP at 25° C.

EXAMPLE 7

Preparation of DRA Dispersion in Methyl Oleate

The process of Example 4 was followed using 50 parts methyl oleate instead of light paraffinic oil. After cooling, the product DRA dispersion of hydroxylaluminum bis-(2-ethylhexanoate), was obtained as an opaque yellow liquid with a viscosity of 45 cP at 25° C.

EXAMPLE 8

Preparation of DRA Dispersion in Hexylene Glycol

To 44.7 parts hexylene glycol were added 31.25 parts oxyaluminum octoate and 13.48 parts 2-ethylhexanoic acid. The mixture was mixed vigorously with an overhead stirrer apparatus. The clear solution was heated to 120° C. for one hour. After cooling, the product DRA dispersion of hydroxyaluminum bis-(2-ethylhexanoate) was obtained as an opaque liquid with a viscosity of 45 cP at 25° C.

EXAMPLE 9

Preparation of DRA Dispersion in Poly(Alpha Olefin) 825 Molecular Weight

To 50 parts poly(alpha olefin) 825 molecular weight were added 25 parts oxyaluminum octoate and 15 parts 2-ethylhexanoic acid. The mixture was mixed vigorously with an overhead stirrer apparatus. The dear solution was heated to 120° C. for one hour. After cooling, the product DRA dispersion of hydroxyaluminum bis-(2-ethylhexanoate), was obtained as an translucent yellow liquid with a shear-rate dependent viscosity at 25° C. (viscosity=12800 cP at 50 dynes/cm$^2$, 620 cP at 100 dynes/cm$^2$).

EXAMPLE 10

Preparation of DRA Dispersion in Light Paraffinic Oil

Thirty-three (33) parts aluminum octoate and 76 parts light paraffinic oil were heated at 120° C. with vigorous agitation for one hour or until a stable dispersion was obtained. The resulting white opaque liquid product had a viscosity of 261,000 cP at 25° C.

EXAMPLE 11

Torque Testing of Example 4 Dispersion Product

Figure 3:
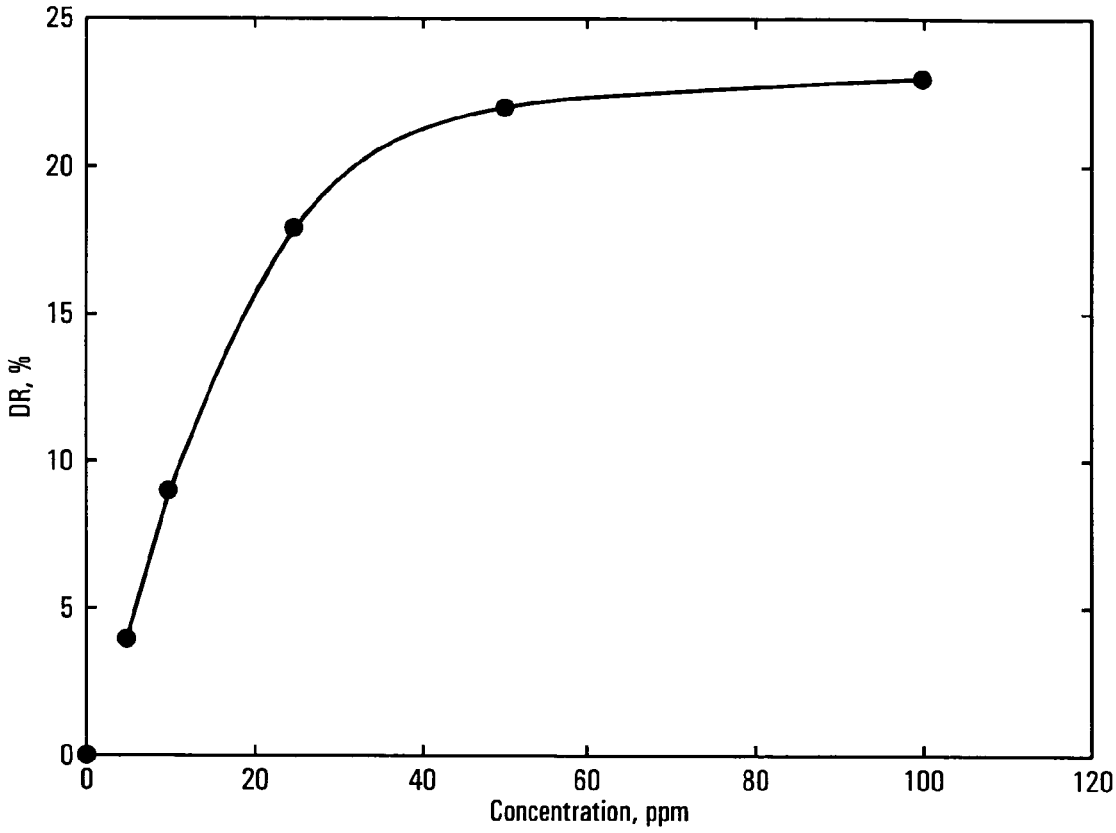
FIG. 3 is a graph of percent drag reduction (DR) as a function of concentration of active drag reducing agent (DRA) in ppm for the aluminum dicarboxylate dispersion of Example 4 in cyclopentane.

The drag reduction—concentration profile for the dispersion product of Example 4 in cyclopentane obtained in the torque test is shown in FIG. 3. These results indicate high drag reduction activity of the dispersion in cyclopentane with minimum effective concentration of about 30 ppm.

Many modifications may be made in the composition and implementation of this invention without departing from the spirit and scope thereof that are defined only in the appended claims. For example, the exact combination of drag reducing additive(s) and liquid having its friction properties modified may be different from those used here. Additionally, aluminum carboxylates other than those specifically mentioned may find utility in the methods of this invention. Various combinations of aluminum carboxylates or solvents thereof, alone or together with other materials besides those explicitly mentioned herein, are also expected to find use as drag reducing agents. Additionally, the exact combination of component A (aluminum monocarboxylate) with component B (fatty acid) in the reaction and injection in situ embodiment herein and liquid having its friction properties modified may be different from those used here. Alternatively, the exact combination of aluminum dicarboxylate with solvent to form the dispersions of one embodiment of the invention and liquid having its friction properties modified may be different from those used here, but still within the scope of this invention. Further, the term "aluminum dicarboxylate" should be understood herein to include compounds that may have an average of somewhat more than 2 carboxylate groups, for instance the use of about a 2.5 carboxylate falls within the definition of dicarboxylates herein.

We claim:

1. A method of reducing drag of a fluid comprising:

providing a fluid selected from the group consisting of hydrocarbons, mixtures of hydrocarbons and water, and mixtures of hydrocarbons, water and gas; and adding to the fluid a drag reducing composition comprising an amount of an aluminum carboxylate effective to reduce the drag of the fluid, where the bulk fluid viscosity of the fluid is not increased by the aluminum carboxylate.

2. The method of claim 1 where the aluminum carboxylate is an aluminum dicarboxylate.

3. The method of claim 1 where the aluminum carboxylate is selected from the group consisting of aluminum dioctoate, aluminum distearate, aluminum octoateoleate, aluminum octoatestearate, aluminum stearateoleate, hydroxyaluminum bis-(2-ethylhexanoate), and mixtures thereof.

4. The method of claim 1 where the amount of aluminum carboxylate based on the total amount of fluid ranges from about 10 to 2000 ppm.

5. The method of claim 1 where the drag reducing composition further comprises a hydrocarbon solvent.

6. The method of claim 1 where the drag reducing composition is prepared by a process comprising reacting:

at least one aluminum monocarboxylate with at least one carboxylic acid having from 6 to 54 carbon atoms to form an aluminum dicarboxylate drag reducing additive;

where the reacting is conducted prior to and/or simultaneously with the adding.

7. The method of claim 6 where the reaction is performed in the presence of a hydrocarbon solvent.

8. The method of claim 6 where the reaction is conducted at a temperature in the range of from about room temperature to about 350° F. (about 25° C. to about 177° C.).

9. The method of claim 6 where the reaction and the addition of the drag reducing composition to the fluid are performed continuously.

10. The method of claim 1 where the drag reducing composition comprises a dispersion comprising from about 5 to about 50 vol % of at least one aluminum dicarboxylate and at least one solvent selected from the group consisting of paraffin oils, fatty acid esters, glycols, diglycols, polyglycols, low molecular weight poly(alpha-olefins), and mixtures thereof.

11. The method of claim 10 where, in the dispersion, the solvent is paraffin oil having a viscosity of greater that about 20 centistokes at 40° C.

12. The method of claim 10 where the dispersion further comprises up to about 10 vol % of at least one co-solvent selected from the group consisting of alcohols, aromatic hydrocarbons, light hydrocarbons and mixtures thereof.

13. A method of reducing drag of a fluid comprising:

providing a fluid selected from the group consisting of hydrocarbons, mixtures of hydrocarbons and water, and mixtures of hydrocarbons, water and gas; and adding to the fluid a drag reducing composition comprising from about 10 to 2000 ppm, based on the total amount of fluid, of an aluminum carboxylate selected from the group consisting of aluminum dioctoate, aluminum distearate, aluminum octoateoleate, aluminum octoatestearate, aluminum stearateoleate, hydroxyaluminum bis-(2-ethylhexanoate), and mixtures thereof, where the bulk fluid viscosity of the fluid is not increased by the aluminum carboxylate.

14. A method of reducing drag of a fluid comprising:

providing a fluid selected from the group consisting of hydrocarbons, mixtures of hydrocarbons and water, and mixtures of hydrocarbons, water and gas;

reacting at a temperature in the range of from about room temperature to about 350° F. (about 25° C. to about 177° C.):

at least one aluminum monocarboxylate made from a fatty acid having from 6 to 54 carbon atoms, with at least one carboxylic acid having from 6 to 54 carbon atoms to form an aluminum dicarboxylate drag reducing additive; and adding to the fluid an amount of the aluminum dicarboxylate drag reducing additive effective to reduce the drag of the fluid, where the bulk fluid viscosity of the fluid is not increased by the aluminum carboxylate, where the reacting is conducted prior to and/or simultaneously with the adding.

15. A method of reducing drag of a fluid comprising:

providing a fluid selected from the group consisting of hydrocarbons, mixtures of hydrocarbons and water, and mixtures of hydrocarbons, water and gas; and adding to the fluid a drag reducing dispersion comprising from about 5 to about 50 vol % of at least one aluminum dicarboxylate and at least one solvent selected from the group consisting of paraffin oils, fatty acid esters, glycols, diglycols, polyglycols, low molecular weight poly(alpha-olefins), and mixtures thereof, where the viscosity of the dispersion ranges from about 20 to about 500,000 cP at 25° C., and where the bulk fluid viscosity of the fluid is not increased by the aluminum carboxylate.

16. A reduced drag fluid comprising:

a fluid selected from the group consisting of hydrocarbons, mixtures of hydrocarbons and water, and mixtures of hydrocarbons, water and gas; and a drag reducing composition comprising an amount of an aluminum carboxylate effective to reduce the drag of the fluid, where the bulk fluid viscosity of the fluid is not increased by the aluminum carboxylate.

17. The reduced drag fluid of claim 16 where the aluminum carboxylate is an aluminum dicarboxylate.

18. The reduced drag fluid of claim 16 where the aluminum carboxylate is selected from the group consisting of aluminum dioctoate, aluminum distearate, aluminum octoateoleate, aluminum octoatestearate, aluminum stearateoleate, hydroxyaluminum bis-(2-ethylhexanoate), and mixtures thereof.

19. The reduced drag fluid of claim 16 where the amount of aluminum carboxylate based on the total amount of reduced drag fluid ranges from about 1 to 100 ppm.

20. The reduced drag fluid of claim 16 further comprising a hydrocarbon solvent.

21. The reduced drag fluid of claim 16 where the drag reducing composition is made by a process comprising reacting:

at least one aluminum monocarboxylate with at least one carboxylic acid having from 6 to 54 carbon atoms to form an aluminum dicarboxylate drag reducing additive.

22. The reduced drag fluid of claim 21 where the reaction is performed in the presence of a hydrocarbon solvent.

23. The reduced drag fluid of claim 21 where the reaction is conducted at a temperature in the range of from about room temperature to about 350° F. (about 25° C. to about 177° C.).

24. The reduced drag fluid of claim 16 where the drag reducing composition comprises a dispersion comprising from about 5 to about 50 vol % of at least one aluminum dicarboxylate and at least one solvent selected from the group consisting of paraffin oils, fatty acid esters, glycols, diglycols, polyglycols, low molecular weight poly(alpha-olefins), and mixtures thereof.

25. The reduced drag fluid of claim 24 where in the dispersion the solvent is paraffin oil having a viscosity of greater that about 20 centistokes at 40° C.

26. The reduced drag fluid of claim 24 where the dispersion further comprises up to about 10 vol % of at least one co-solvent selected from the group consisting of alcohols, aromatic hydrocarbons, light hydrocarbons and mixtures thereof.

27. A reduced drag fluid comprising:

a fluid selected from the group consisting of hydrocarbons, mixtures of hydrocarbons and water, and mixtures of hydrocarbons, water and gas; and a drag reducing composition comprising from about 10 to 2000 ppm, based on the total amount of fluid, of an aluminum carboxylate selected from the group consisting of aluminum dioctoate, aluminum distearate, aluminum octoateoleate, aluminum octoatestearate, aluminum stearateoleate, hydroxyaluminum bis-(2-ethylhexanoate), and mixtures thereof, where the bulk fluid viscosity of the fluid is not increased by the aluminum carboxylate.

28. A reduced drag fluid comprising:

a fluid selected from the group consisting of hydrocarbons, mixtures of hydrocarbons and water, and mixtures of hydrocarbons, water and gas;

an amount of an aluminum carboxylate drag reducing additive effective to reduce the drag of the fluid, where the additive is prepared by reacting:

at least one aluminum monocarboxylate made from a fatty acid having from 6 to 54 carbon atoms, with at least one carboxylic acid having from 6 to 54 carbon atoms to form an aluminum dicarboxylate drag reducing additive at a temperature in the range of from about room temperature to about 350° F. (about 25° C. to about 177° C.)

where the bulk fluid viscosity of the fluid is not increased by the aluminum carboxylate.

29. A reduced drag fluid comprising:

a fluid selected from the group consisting of hydrocarbons, mixtures of hydrocarbons and water, and mixtures of hydrocarbons, water and gas; and a drag reducing dispersion comprising from about 5 to about 50 vol % of at least one aluminum dicarboxylate and at least one solvent selected from the group consisting of paraffin oils, fatty acid esters, glycols, diglycols, polyglycols, low molecular weight poly(alpha-olefins), and mixtures thereof, where the viscosity of the dispersion ranges from about 20 to about 500,000 cP at 25° C., and where the bulk fluid viscosity of the fluid is not increased by the aluminum carboxylate.

* * * * *